United States Patent [19]

Eads

[11] Patent Number: 4,832,595

[45] Date of Patent: May 23, 1989

[54] TORCH NOZZLE ASSEMBLY

[76] Inventor: James B. Eads, 2283 Clear Creek Dr., Nicholasville, Ky. 40356

[21] Appl. No.: 892,358

[22] Filed: Jul. 31, 1986

[51] Int. Cl.[4] ..... F23N 1/00

[52] U.S. Cl. ..... 431/89; 431/255; 431/344; 137/504; 251/149.8; 251/349

[58] Field of Search ..... 137/484.27, 504; 251/149.8, 349; 431/89, 254, 255, 344

[56] References Cited

U.S. PATENT DOCUMENTS

| | | | |
|---|---|---|---|
| 2,664,266 | 12/1983 | Johnson | 251/349 X |
| 2,808,714 | 10/1957 | Wilson | 431/254 |
| 2,967,543 | 1/1961 | Viergutz | 137/484.2 |
| 3,042,075 | 7/1962 | Pettibone | 137/539 |
| 3,155,140 | 11/1964 | Wilson | 431/153 |
| 3,406,001 | 10/1968 | Ishibashi | 431/256 X |
| 3,436,164 | 4/1969 | Deucher | 431/255 |
| 3,583,846 | 6/1971 | Kimball | 431/142 |
| 3,667,895 | 6/1972 | Ross | 431/255 |
| 3,736,093 | 5/1973 | Bowman et al. | 431/89 |
| 4,348,172 | 9/1982 | Miller | 431/255 |

FOREIGN PATENT DOCUMENTS

| | | | |
|---|---|---|---|
| 2811901 | 3/1979 | Fed. Rep. of Germany | 431/256 |
| 83/00279 | 2/1983 | PCT Int'l Appl. | 126/408 |

*Primary Examiner*—Samuel Scott
*Assistant Examiner*—Allen J. Flanigan
*Attorney, Agent, or Firm*—King & Schickli

[57] ABSTRACT

A gas fuel torch assembly is provided for attachement to a portable pressurized gas fuel cylinder. The assembly includes a housing and a gas delivery system in the housing. The system delivers gas fuel from the cylinder within an adjustable operating pressure range to a burn tube connected to the housing. The gas delivery system includes a gas passageway, an on/off valve and a pressure regulator valve assembly. The pressure regulator valve assembly includes a regulator body slidably received in the housing and an adjustable regulator valve stem. A metering orifice provided in the gas passageway of the regulator body defines a maximum pressure at which gas fuel is fed into the burn tube. Both the on/off valve and regulator valve include spring biased resilient ball members loosely held within enlarged valve chambers.

28 Claims, 2 Drawing Sheets

TORCH NOZZLE ASSEMBLY

TECHNICAL FIELD

The present invention relates generally to portable gas fuel torches and, more particularly, to a nozzle assembly for a torch of simplified structure that facilitates manufacture so as to be less expensive to produce. Advantageously, the nozzle assembly also provides more reliable performance and consistent operation, and is more rugged in design.

BACKGROUND OF THE INVENTION

A number of different torch nozzles have been developed in the art for attachment to portable pressurized gas fuel cylinders, canisters or containers of liquified petroleum products such as propane. These types of gas torches are frequently used by plumbers, electricians and mechanics in soldering, brazing and welding operations.

In many of these applications the character of the flame produced by the torch is of critical importance to the effective, efficient or even successful completion of the particular job. For example, when binding together two or more fusible materials by melting, a particular flame temperature must be reached and maintained. Fluctuations of the shape of the fame or in the flame temperature produced by the torch during the melting operation could needlessly prolong the job or prevent the binding from being properly completed.

Such fluctuations can be caused by a number of factors. Specifically, as the torch is used, gas is depleted from the cylinder and the internal pressure of the cylinder decreases. Without proper regulation this leads to the production of a smaller flame at an insufficient temperature for the particular operation being conducted. Further, it should be appreciated that changes in the ambient temperature can also effect the internal pressure of the cylinder and, therefore, the pressure with which gas is emitted from the cylinder.

For example, a plumber may spend the morning operating a torch outdoors in freezing temperatures. During this time the plumber adjusts the characteristics of the torch to suit the particular application to which the torch is being used. Later in the day outdoor temperature may rise or his work may move indoors to a heated area. As the ambient temperature of the fuel gas cylinder rises, so does the pressure of the fuel gas in the cylinder.

Pressurized fuel gas subsequently emitted from the cylinder is, therefore, at a constantly rising pressure requiring continuous adjustment. The operator of the torch has no alternative but to be constantly alert to change the setting as the gas warms.

This prior art practice of constant adjustment has proven to be a satisfactory arrangement over the years. However, it is obviously desirable to avoid this cumbersome and inconvenient practice of having to continually change the valve setting, if possible. Previously, avoidance of this difficulty has been attempted by providing in a torch nozzle assembly a mechanism to automatically regulate the gas fuel delivery pressure. Some of these attempts have been reasonably effective in producing a flame of reasonably constant characteristics under a wide range of operating conditions.

Examples of the various regulator mechanisms utilized to date are provided from a review of U.S. Pat. Nos. 3,736,093 to Bowman et al. and 4,348,172 to Miller. The Bowman patent discloses a nozzle assembly including a regulator valve having a spring and diaphragm combination. This regulator valve automatically increases and decreases the fuel flow from a fuel gas tank or cylinder in response to a decrease or increase, respectively, in the internal tank pressure caused by the ambient operating temperature.

The Miller patent also discloses a regulator valve for maintaining a substantially constant gas pressure. The regulator valve includes a valve core, a regulator piston and a cooperating "spider like" contact plate. During operation the gas pressure serves to lift the piston from the plate against the pressure of a spring so as to allow the passage of gas.

While the spring and diaphragm approach in Bowman and the valve core, regulator piston and contact plate combination in Miller are relatively effective in regulating the pressure of gas delivery, they are not without their disadvantages. These relatively complicated mechanisms are expensive to manufacture, difficult to adjust accurately and time consuming and costly to maintain in proper working order. As such, a need is identified for an improved gas pressure regulator mechanism that provides effective performance while being both simple and inexpensive to construct and maintain.

SUMMARY OF THE INVENTION

Accordingly, it is a primary object of the present invention to provide a lightweight, compact gas fuel torch nozzle assembly for attachment to a portable pressurized gas fuel cylinder.

It is another object of the present invention to provide a nozzle assembly having a simplified structure for the control of gas flow that facilitates manufacture so as to be less expensive to produce.

A further object of the present invention is to provide a nozzle assembly furnishing more reliable overall performance and having a structure that provides increased protection against shock loading.

An additional object of the present invention is t provide a nozzle assembly that produces a flame of substantially constant characteristics despite variations or fluctuations in the fuel pressure as delivered from the cylinder during use.

Yet another object is to provide a nozzle assembly furnishing consistent and accurate fuel pressure regulation across a wide range of operating conditions.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

In accordance with the objects, advantages and other novel features of the present invention an improved and simplified nozzle assembly for a gas fuel torch is provided. The nozzle assembly is particularly designed for attachment to a portable pressurized gas fuel cylinder. The nozzle assembly includes a housing and a burn tube connected to the housing through which the flame is directed following ignition. A gas delivery system within the housing includes a gas delivery passageway for delivering gas fuel from the cylinder to the burn tube. The system also includes a regulator valve assembly to control the flow of gas fuel from the cylinder. Formed integrally with the regulator valve assembly is an on/off valve assembly.

The regulator valve assembly accurately and continuously controls the pressure at which gas fuel is delivered to the burn tube. Regardless of the pressure in the cylinder, the proper gas flow is maintained through the system.

Furthermore, when the pressure of the gas delivered from the cylinder falls below the set pressure determined to be a minimum at which the desired characteristics, such as the temperature of the flame, can be maintained, gas delivery is shut off and the flame extinguished. As a result the operator is immediately signaled when a new gas cylinder is required to complete the work in progress. The shut-off function serves to eliminate wasted time through torch operation with a flame of insufficient temperature to provide effective operation.

More specifically, the on/off valve assembly is advantageously formed at the end of a regulator body that is selectively displaceable within the housing. In the "off" position, the regulator body engages a resilient ball element of the on/off valve assembly. Through this engagement the regulator body presses the ball element into firm sealing engagement with the valve seat in the gas passageway to stop delivery of gas fuel from the cylinder. In the "on" position, the regulator body is displaced so as to release the ball element from the valve seat. The pressurized gas fuel then unseats the ball element from the valve seat and flows around the ball element, which is now free floating, and continues through the regulator valve assembly.

Actuation of the regulator body is provided by means of a lever extending from the housing. A spring biases the regulator body to the "off" position. Thus, if, for example, the torch is dropped by the operator, the regulator body acts like a "dead man" switch and gas flow is shut off and the flame extinguished for safety.

Preferably, the regulator valve assembly comprises a resilient ball element received within a valve chamber. A coil spring and cooperating plunger bias the regulator ball element into a seated position across the gas passageway to regulate the flow of gas. When gas fuel pressure received from the cylinder drops below a minimum necessary for operating pressure, the regulator ball element is forced into the seat and shuts off the flow. As the pressure rises for any reason, the increased compressive force of the regulator spring tends to throttle the gas and maintain the desired flame size and intensity.

The operating pressure may be adjusted by means of rotation of a regulator stem threadedly connected o the regulator body. Specifically, rotation of the stem allows the biasing tension of the coil spring to be adjusted. A metering orifice also defines the maximum pressure at which gas fuel may be delivered from the regulator body to the burn tube. As an additional safety feature, the regulator stem in the regulator body bottoms out on the plunger when turned to the full "off" position. In this condition, the torch is disabled even if the trigger is actuated and the on/off valve opened.

The on/off valve assembly and regulator valve assembly are axially aligned along the regulator body. The gas passageway in the body extends straight through both valve assemblies. This alignment provides excellent flow through the system.

The one-piece regulator body is protected against shock loading by being mounted at both ends; one end in an upper end cap and the other end in a connector cap, both with O-ring seals. Because of the axial positioning the protection is further increased. Indeed, shock tests performed by dropping the nozzle assembly have proven its superiority of ruggedness and reliability over the previous designs.

In addition, the simplified integral valve assembly design eliminates any need for intricately machined corners or gas passageways in the housing. Thus, manufacturing costs are substantially reduced.

The utilization of valves incorporating simple resilient ball elements increases the sealing efficiency while further reducing overall production and maintenance costs. Since the ball elements are free floating, on each seating the ball element is in a different position. Thus wear and permanent set of the valve elements is virtually eliminated. The resilient concept also helps protect against shock damage, either from rapid release of the trigger or from inadvertantly dropping the torch.

Each of the resilient ball elements is approximately 0.187 inches in diameter. Preferably each ball element is formed of a material having a Durometer rating of 70, although materials having a Durometer rating in the range of 50–90 still provide acceptable sealing and wear characteristics.

Still other features include the provision of an ignitor ram mounted to and concentrically disposed about the regulator body. This ignitor ram serves to actuate an ignitor upon initial actuation of the lever so as to create a spark that ignites the gas fuel being delivered to the burn tube. The ignitor ram, in the form of a disk, also includes an aperture for the receipt of an antirotation pin. The regulator body is maintained in position at all times, even when the regulator stem is rotated relative thereto to adjust the gas pressure.

Still other objects of the present invention will become readily apparent to those skilled in the art from the following description wherein there is shown and described a preferred embodiment of the invention, simply by way of illustration of one of the modes best suited to carry out the invention. As it will be realized, the invention is capable of other different embodiments, and its several details are capable of modifications in various, obvious aspects all without departing from the invention. Accordingly, the drawings and desriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE INVENTION

Figure 1:
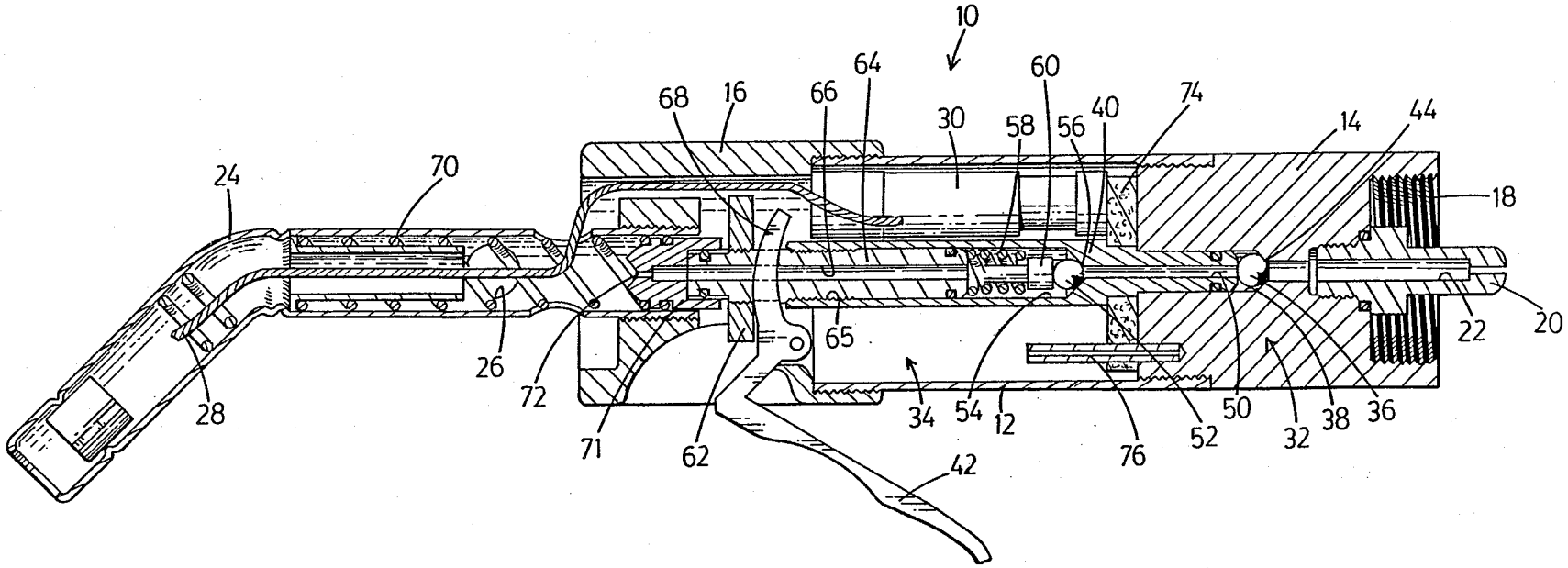
FIG. 1 is a cross-sectional view of the torch nozzle assembly of the present invention in the "off" position.

Reference is now made to FIG. 1 showing the improved nozzle assembly 10 of the present invention for attachment to a portable pressurized gas fuel cylinder (not shown) to form a torch. The assembly 10 comprises a housing 12, including a lower connector cap 14 and an upper end cap 16, both threadedly connected thereto. The connector cap 14 includes a threaded cavity 18 for threading on the neck of a conventional propane gas container, tank or cylinder.

When properly connected to a gas cylinder, the valve pin 20 of the assembly 10 extends into the cylinder and engages and depresses a conventional internal valve in the cylinder, as is known in the art. This releases fuel gas from the cylinder into passage 22 of the valve pin 20. This passage 22 communicates directly with the gas delivery system of the assembly 10 that delivers fuel gas from the cylinder to the burn tube 24 where it is mixed with air through venturi openings 26 and ignited with a spark from electrode 28 extending from piezoelectric ignitor 30.

Figure 2:
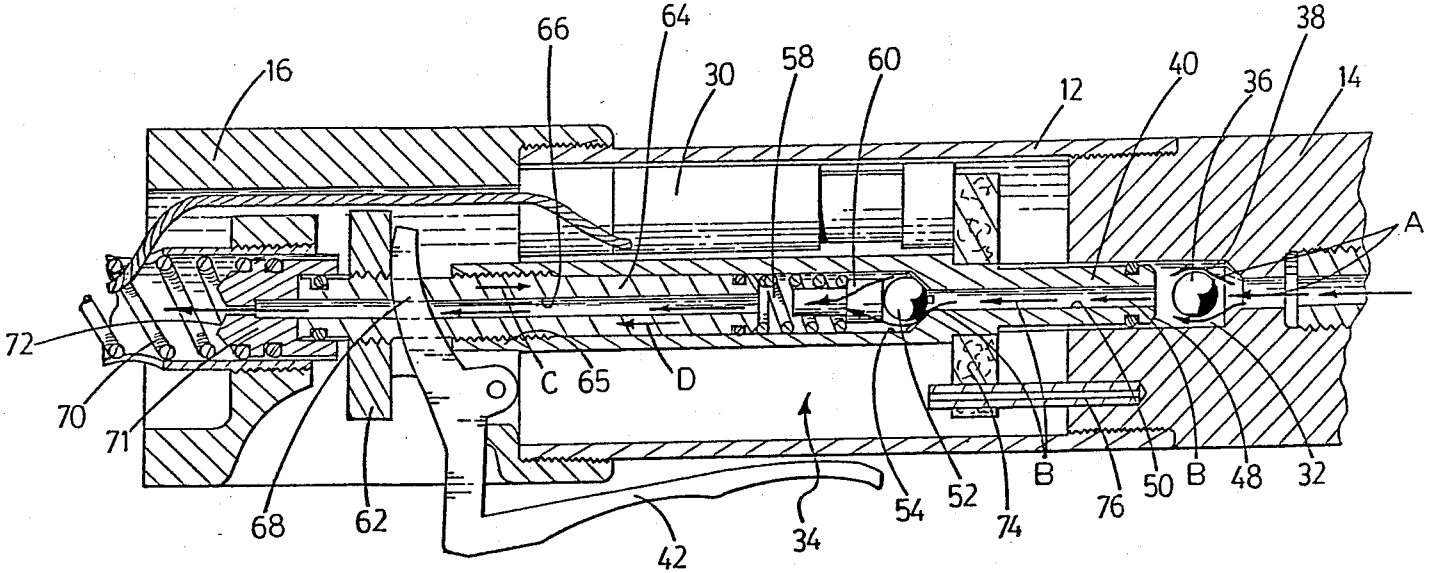
FIG. 2 is an enlarged cutaway cross-sectional view showing the torch nozzle assembly with the lever and regulator body in the "on" position and clearly indicating the flow of gas fuel through the assembly.

As shown in FIGS. 1 and 2, the gas delivery system includes an on/off valve assembly, generally designated by reference numeral 32, and integral with a regulator valve assembly, generally designated by reference numeral 34. The on/off valve assembly 32 controls the flow of gas fuel from the cylinder through passage 22 into the gas delivery system. Regulator valve assembly 34 controls the pressure at which gas fuel is delivered through the gas delivery system to the burn tube 24 for combustion.

The on/off valve assembly 32 includes a resilient ball element 36 loosely held within an enlarged valve chamber 38. A regulator body 40 slidably received within the housing 12 controls the axial movement of the on/off ball element 36. Specifically, the regulator body 40 is selectively displaceable by means of actuation of the lever 42 between independent "off" and "on" positions. In the "off" position shown in FIG. 1, the regulator body 40 engages the ball element 36 and brings the ball element into a seated position across the gas orifice 44 thus blocking the flow of fuel gas through the passageway. In the "on" position shown in FIG. 2, the ball element 36 is unseated from the orifice 44 passageway by the pressure of the fuel gas from the cylinder (note action arrows A) and is pushed forward so as to engage the end 46 of the regulator body 40.

Figure 3:
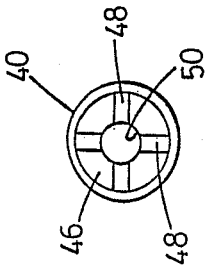
FIG. 3 is a view of the face of the regulator body of the torch nozzle assembly showing the undercut grooves for the passage of gas to the central bore of the regulator body.

As best shown in FIG. 3, the end 46 of the regulator body 40 includes undercut grooves 48 that allow the passage of fuel gas into the central bore 50 of the regulator body even when the ball element 36 is in contact with the end.

The fuel gas continues to flow through the bore 50 in the direction of action arrows B (see FIG. 2) until reaching resilient ball element 52 of the regulator valve assembly 34. As shown in FIG. 1, the resilient ball element 52 is biased in valve chamber 54 into a seated position so as to rest in a cooperating valve seat across the gas orifice 56 by means of a cooperating coil spring 58 and plunger 60. Thus, only when the fuel gas being delivered by the cylinder is at a pressure sufficiently great to move the ball element 52 against the compression of the spring 58 does gas continue to flow through the delivery system to the burn tube 24. In this way, the apparatus of the present invention assures during operation the delivery of the necessary gas pressure to produce a flame of sufficient temperature to complete a soldering, brazing or welding operation.

In the event the pressure in the cylinder is too low for any reason to produce a flame burning at the necessary temperature for the present application, torch assembly operation is cut off and the flame extinguished.

The ball elements 36, 52 are 0.187 inch in diameter and of a resilient material, such as urethane rubber, with a Durometer hardness rating of 50–90 and preferably 70. The resilient ball elements seat better forming more reliable regulation and cut-off of the gas. Any shock loading created in the valve structure, especially due to sudden cut-off, is absorbed by the ball elements 36, 52. The hardness factor selected assures against problematic wear and/or permanent set in the surface.

As best appreciated from viewing FIG. 2, the compressive force provided by the coil spring 58 against the ball element 52 may be adjusted by means of the nut or finger wheel 62 mounted in the housing end cap 16. This nut 62 is fixed to a regulator stem 64 received in the regulator body 40 by threads 65. By rotating the nut 62 so as to advance the regulator stem 64 in the direction of arrow C into the regulator body 40, the compressive force provided by the coil spring 58 against the ball element 52 is increased. This in turn increases tee fuel gas pressure required to unseat and hold open the ball element 52. For safety, the regulator stem 64 bottoms out against the plunger 60 when turned all the way to the full "off" position. In this condition, the ball element 52 is held securely in its seat and the torch is thus disabled even if the trigger 42 is actuated and the on/off valve assembly 32 is opened.

Conversely, by rotating the nut 62 so as to retract the regulator stem 64 by the threads 65 in the direction of arrow D from the regulator body 40, the compressive force provided by the coil spring 58 is reduced. This results in a proportional reduction in the minimum gas pressure required to unseat he ball element 52. In this way, the operating gas pressure and thus the flame size of the torch nozzle assembly 10 is increased.

The concept of forming the on/off valve assembly 32 integral with the regulator valve assembly 34 provides significant advantages over the prior art. The two valve assemblies are significantly less costly to manufacture as a single unit. The straight-through bore 50 not only provides for cost savings, but significantly more efficient gas flow. Reliability and consistent operation is also enhanced by the integral dual valve assembly arrangement since the regulator body 40 houses, operates and protects the valve parts. The regulator body 40 is securely mounted in O-rings at both ends; one end in the end cap 16 and the other end in the connector cap 14. This feature has proven especially signifcant in preventing any damage to the nozzle assembly under severe shock loading.

The operation of the torch nozzle assembly 10 is very straight forward. The assembly 10 is first attached to fuel gas or propane cylinder as described above in a manner well known in the art. The lever 42 is then pivoted from the "off" position shown in FIG. 1 into the "on" position shown in FIG. 2. As this is done an arcuate actuating face 68 of the actuator lever 42 engages the nut 62 so as to move the nut and the attached regulator stem 64 and body 40 forward in the direction of action arrow D against the spring 70. When this occurs the on/off ball element 36 is freed from its cooperating seat at orifice 44. The pressurized fuel gas from the cylinder then pushes the ball element 36 to its free floating position. Thus, fuel gas flows past the on/off valve 32 and through the central bore 50 as shown by action arrows A and B.

If the fuel gas is being delivered from the cylinder at operating pressure, the fuel gas also unseats the regulator ball element 52 and flows past the plunger 60 through the central bore 66 of the regulator stem 64. From there, the fuel gas is delivered through a nozzle element 71 having metering orifice 72 into the burn tube 24. The metering orifice 72 limits the maximum pressure at which fuel gas is allowed to pass into the burn tube 24.

The regulator valve assembly 34 assures a safe, narrow adjusted range of operation of the torch. In other words, the nozzle assembly 10 accurately and consistently controls the flow of gas to maintain the desired flame size and thus the heat intensity.

More particularly, the end face of plunger 60 cooperates with the end face of the regulator stem 64 such that as the ball element 52 reacts to any change in pressure in the gas supply, flow is appropriately adjusted to maintain a more or less constant flow. Any wide changes in pressure are compensated by readjustment of the nut 62 and regulator stem 64.

Furthermore, the fuel gas pressure is always maintained above the minimum pressure necessary to provide effective operation by the regulator valve 34. The metering orifice 72 always limits the maximum operating pressure. This additionally assures that a flame is produced with substantially constant and consistent characteristics including both shape and temperature even at the lower settings.

Of particularly great interest is that the regulator valve assembly 34 requires very low cost parts including the simple loose fitting plunger 60 and loose, free floating ball element 52. Thus, even after severe shock, the plunger/ball element won't stick. In addition to eliminating sticking, expensive machining of close fitting parts (as in the Miller U.S. Pat. No. 4,348,172, supra) and multiple direction passages is eliminated providing the substantial cost savings. The cost savings, as well as operational advantages, are significantly enhanced by making the on-off valve assembly 32 integral with the regulator valve assembly 34.

Once delivered from the metering orifice 72 to the burn tube 24, the fuel gas flows past the venturi openings 26 and mixes with air. The fuel gas/air mixture is then ignited by means of the spark electrode 28 contained within the burn tube 24. The spark electrode 28 is connected to a piezoelectric ignitor 30. A built-in delay assures that a spark is delivered only after the fuel gas has had time to move through the gas delivery system to the burn tube 24.

A disc shaped ignitor ram 74 fixed to and concentrically mounted around the regulator body 40 engages and actuates the ignitor 30 when the lever 42 is drawn into the "on" position. As shown, the ignitor ram 74 also includes an aperture for the receipt of an antirotation pin 76. This pin 76, aligned and parallel with the longitudinal axis of the regulator stem 64 and body 40 prevents rotation of the regulator body 40 under all conditions including when the regulator stem is rotated relative thereto so as to adjust the operating gas pressure.. The nut 62 may be calibrated to provide an approximate indication of the set operating temperature.

In summary, numerous benefits have been described which result from employing the concepts of the present invention. Through the utilization of axially aligned and integral on/off and regulator valve assemblies 32, 34, overall construction of the device is simplified, provides cleaner, freer straight-through gas fuel flow and is improved in reliability and made shock proof. The utilization of resilient ball elements 36, 52 in the on/off and regulator valves further simplifies construction and reduces initial manufacturing and subsequent maintenance costs, as well as increasing valve sealing efficiency. Additionally, the regulator valve assembly 34 and metering orifice 72 advantageously provide a torch nozzle assembly 10 that assures effective operation within a narrow gas fuel pressure range. The minimum pressure is set by the adjustable regulator valve assembly and a maximum pressure maintained by the valve assembly and the metering orifice. This is true despite fluctuations in the fuel gas pressure within the cylinder.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A gas fuel torch nozzle assembly for attachment to a portable pressurized gas fuel cylinder, comprising:

a housing;

a burn tube connected to said housing; and a gas delivery system within said housing including a gas deliver passageway for delivering gas fuel from said cylinder to said burn tube, said gas delivery system further including an on/off valve assembly to control the flow of gas fuel from said cylinder into said torch nozzle assembly; said on/off valve assembly being integral with a pressure regulator means, said pressure regulator means including a regulator valve assembly and a selectively displaceable regulator body displaceable within said housing wherein said regulator body engages a valve member of said on/off valve assembly and brings said valve member into an "off" position in sealing engagement across said gas passageway to stop delivery of gas fuel from said cylinder and an "on" position wherein gas fuel flows through said gas passageway around said valve member, said regulator pressure means controlling the pressure at which gas fuel is delivered through said gas delivery system to said burn tube.

2. The torch nozzle assembly of claim 1, wherein said regulator body is actuated by means of a lever extending from said housing.

3. The torch nozzle assembly of claim 1, wherein means are provided for biasing said regulator body to said "off" position.

4. The torch nozzle assembly of claim 3, wherein said on/off valve member is a resilient ball element loosely held within an enlarged valve chamber.

5. The torch nozzle assembly of claim 1, wherein said regulator valve assembly includes a resilient regulator ball element received within a valve chamber, said resilient ball element seating across said gas passageway to regulate the flow of gas and to stop the flow when fuel gas pressure received from said cylinder drops below a minimum operating pressure.

6. The torch nozzle assembly of claim 5, wherein means are provided in said regulator body for biasing said resilient regulator ball element toward a seated position.

7. The torch nozzle assembly of claim 6, wherein said biasing means includes a coil spring and cooperating plunger.

8. The torch nozzle assembly of claim 1, wherein said on/off valve assembly and said regulator valve assembly are axially aligned along said gas passageway within said housing.

9. The torch nozzle assembly of claim 8, wherein said regulator body is also axially aligned with said on/off and regulator valve assemblies.

10. The torch nozzle assembly of claim 1, wherein said regulator body includes a metering orifice defining a maximum pressure at which gas fuel may be delivered from said regulator body to said burn tube.

11. The torch nozzle assembly of claim 3, wherein an ignitor ram is mounted to said regulator body and an ignitor is provided in said housing; initial actuation of said regulator body to said on position serving to actuate said ignitor with said ignitor ram thereby causing a spark to ignite gas fuel being delivered to said burn tube.

12. The torch nozzle assembly of claim 11, wherein said ignitor ram is concentrically disposed about said regulator body and includes an aperture for the receipt of an antirotation pin.

13. The torch nozzle assembly of claim 7, wherein said resilient ball member is constructed of material having a Durometer rating of between 50 and 90.

14. The torch nozzle assembly of claim 13, wherein said resilient ball member is constructed of material having a Durometer rating of 70.

15. The torch nozzle assembly of claim 1, wherein said regulator body is supported adjacent its ends in said housing and positioned substantially axially within said housing to provide improved shock resistance.

16. The torch nozzle assembly of claim 2, wherein said actuator lever is pivotally mounted to said housing and includes an arcuate actuating face for engaging and activating said regulator body.

17. A gas fuel torch nozzle assembly for attachment to a portable pressurized gas fuel cylinder, comprising:

a housing;

a burn tube connected to said housing; and a gas delivery system within said housing including a gas passageway for delivering gas fuel from said cylinder to said burn tube, said gas delivery system further including a pressure regulator valve assembly having a regulator body to control the flow of gas fuel from said cylinder into said torch nozzle assembly and an on/off valve assembly carried by the regulator body and being displaceable within said housing;

said regulator valve assembly including an adjustable valve stem within said regulator body;

a resilient ball element received within a valve chamber, said resilient ball element cooperating with a valve seat in said chamber to regulate the flow of gas;

spring means between said valve stem and said seat;

whereby the pressure of the gas can be regulated by adjustment of said valve stem.

18. The torch nozzle assembly of claim 17, wherein said regulator stem is effective to positively hold said ball element in the seat in the full adjusted "off" position.

19. The torch nozzle assembly of claim 17 wherein said regulator valve assembly is contained within said regulator body.

20. The torch nozzle assembly of claim 17, wherein said regulator body is selectively displaceable within said housing between an off position wherein said regulator body engages a valve member of said on/off valve assembly and brings said valve member into sealing engagement across said gas passageway to stop delivery of gas fuel from said cylinder and an on position wherein gas fuel flows through said gas passageway around said valve member.

21. The torch nozzle assembly of claim 20, wherein said on/off valve member includes a resilient ball element loosely held within an enlarged valve chamber to operate against a valve seat.

22. The torch nozzle assembly of claim 21, wherein said on/off valve assembly and said regulator valve assembly are axially aligned along said housing, said gas passageway extending straight through said assemblies.

23. The torch nozzle assembly of claim 22, wherein said on/off valve assembly is integral with said regulator valve assembly.

24. The torch nozzle assembly of claim 23, wherein said regulator body is supported in end caps on said housing to provide protection against shock.

25. A gas fuel torch nozzle assembly for attachment to a portable pressurized gas fuel cylinder, comprising:

a housing a burn tube connected to said housing; and a gas delivery system within said housing including a gas passageway for delivering gas fuel from said cylinder to said burn tube, said gas delivery system further including an on/off valve assembly and a ball valve assembly for controlling the pressure at which gas fuel is delivered through said gas delivery system to said burn tube; both said on/off valve assembly and ball valve assembly being mounted to a regulator body that is selectively displaceable within said housing.

26. The torch nozzle assembly of claim 25, wherein said pressure regulator ball valve assembly is integral with said on/off valve assembly.

27. The torch nozzle assembly of claim 25, wherein said on/off valve assembly includes a resilient ball element loosely held within an enlarged valve chamber to operate against a valve seat.

28. The torch nozzle assembly of claim 27, wherein said pressure regulator ball valve assembly includes a resilient ball element received within a valve chamber, said resilient ball element seating across said gas passageway to regulate the flow of gas.

* * * * *